United States Patent [19]

Braun et al.

[11] Patent Number: 4,571,004

[45] Date of Patent: Feb. 18, 1986

[54] MECHANISM FOR CONTROLLING THE ELEVATION OF A COAL PLANER

[75] Inventors: Ernst Braun; Gert Braun, both of Essen-Heisingen, Fed. Rep. of Germany

[73] Assignee: Halbach & Braun Industrieanlagen, Fed. Rep. of Germany

[21] Appl. No.: 556,615

[22] Filed: Nov. 30, 1983

[30] Foreign Application Priority Data

Nov. 30, 1982 [DE] Fed. Rep. of Germany ..... 3244230

[51] Int. Cl.[4] ..... E21C 27/32

[52] U.S. Cl. ..... 299/34; 299/43

[58] Field of Search ..... 299/34, 43, 32

[56] References Cited

U.S. PATENT DOCUMENTS

| | | | |
|---|---|---|---|
| 3,284,138 | 11/1966 | Binaut | 299/34 |
| 3,915,500 | 10/1975 | Schulusener et al. | 299/32 |
| 4,045,089 | 8/1977 | Hauschopp et al. | 299/43 |
| 4,327,946 | 5/1982 | Kirchbrücher et al. | 299/43 |
| 4,366,989 | 1/1983 | Braun | 299/34 |
| 4,458,951 | 7/1984 | Merten et al. | 299/34 X |
| 4,462,637 | 7/1984 | Rafael et al. | 299/32 |
| 4,492,410 | 1/1985 | Schlusener et al. | 299/43 |

FOREIGN PATENT DOCUMENTS

| | | | |
|---|---|---|---|
| 1036790 | 8/1958 | Fed. Rep. of Germany | 299/34 |
| 2745446 | 4/1979 | Fed. Rep. of Germany | 299/34 |
| 376562 | 7/1973 | U.S.S.R. | 299/34 |

*Primary Examiner*—Stephen J. Novosad
*Assistant Examiner*—Hoang C. Dang
*Attorney, Agent, or Firm*—McGlew and Tuttle

[57] ABSTRACT

To be able to minimize the size of the lifting cylinder, a control lever is braced against an abutment at the waste side, and hinged on its other end to the piston rod of the lifting cylinder, thereby forming a movable hinge axis. Consequently, in a normal position, the fixed hinge axes of the lifting cylinder and the control lever form a triangle of joints, with the common movable hinge axis therebetween at the inside, i.e. at the side of a control bracket. The control bracket is designed with a bent extension projecting below the conveyor extending toward the planer and forming a scraper edge which alos serves as a tilting axis for angularly positioning the conveyor with the planer. The adjusting device permits of a coal planer conveyor in height as it moves over a coal face with the planer on one side of the conveyor and a bracket secured to the opposite side wall.

5 Claims, 4 Drawing Figures

MECHANISM FOR CONTROLLING THE ELEVATION OF A COAL PLANER

FIELD AND BACKGROUND OF THE INVENTION

This invention relates to mining devices and in particular to a new and useful coal planer conveyor in which the height of movement of the conveyor over the coal face may be varied.

A coal planer control serves the purpose of compensating for irregularities in the configuration of the floor of a longwall working area, or for deviations of the planer from the desired cutting horizon. To this end, the longwall conveyor is lifted or lowered by means of lifting cylinders which are provided at the waste side. In lowered position of the conveyor, the coal planer is positioned to "climb", while in the lifted position, the planer is positioned to "dip". As soon as the planer is positioned for a certain cutting horizon, the lifting cylinder occupies its neutral position and the piston rod is partly extended.

There is known a planer control mechanism in which the lifting cylinder is mounted in inclined position and hinged, by its piston rod end, to a control bracket in the upper portion thereof where a fixed hinge axis is thereby formed, and by its lower end to a control lever where a movable hinge axis is formed, with the control lever also forming an extension of a cross bar and being hinged to the lower portion of the bracket whereby another fixed hinge axis is formed. In this prior art design, due to the inclined position of the lifting cylinder, the movable hinge axis extends outside the bracket. The lifting cylinder thus extends in a relatively unprotected position, and, considering the normal position of the cylinder, the piston rod must be retracted if the planer is to be brought into a climbing position. Conversely, the piston rod must be extended if a dipping position of the planer is desired. Much greater setting forces must be produced to bring the planer into a climbing position, than for bringing it to a dipping position. Since in the prior art design, the climbing position is brought about by retracting the piston rod, just the piston surface, reduced by the cross section of the piston rod, is exposed to pressure to produce relatively high setting forces, while much smaller forces are needed for setting the dipping position. Taking into account a constant pressure of the operating fluid, the lifting cylinders thus must be dimensioned for the highest occurring setting, thus tensile forces, which requires a relatively large lifting cylinder which will be oversized in regard to the forces needed for the dipping position. In addition, in the prior art design the bottom edge of the waste side wall of the conveyor acts as a kind of a skid runner in the normal as well as in the climbing position of the planer, so that it tends to travel uphill on the coal dust cake forming on the floor, which also finally deviates the planer.

Further known is a control for a tearing hook-type planer which is equipped with a bottom sword extending below the conveyor and being secured at the waste side to the planer chain. The chain channels of the planer chain are formed by a U-shaped cover sheet which stands upright on the floor, yet does not project into the zone of the conveyor sidewall at the waste side. Therefore, during the shifting operation, fine coal may penetrate into, and deposit in, the lower chain channel.

The movement may thereby be impeded, and even the chain may finally break.

SUMMARY OF THE INVENTION

The invention is directed to a control for a coal planer wherein the lifting cylinder is mounted in a protected position and is relatively small, at least as to the size or diameter of its piston, and which operates satisfactory in the long run and ensures a shifting space substantially free from fine coal and capable of properly accommodating the control means.

In accordance with the invention a coal planer conveyor may be adjusted in height as it moves over a coal face by an adjusting mechanism which includes a bracket connected to a side of the conveyor which is opposite to the side which carries the coal planer. The bracket includes a lower wall which extends below the bottom of the conveyor and the position of the bracket may be varied so as to adjust the position in which the bottom of the bracket extends toward the coal face by shifting the orientation of the bracket relative to an abutment on a side of the conveyor opposite to the coal planer which may advantageously comprise a service trough. The construction includes a control lever which is pivotally mounted on the bracket and includes one arm or end portion which is pivotally connected to the service trough for movement about a vertical axis and an opposite end which is connected to a combination lifting cylinder and piston which is fluid pressure operated and has its opposite end connected to the brackets adjacent the upper end thereof. Pivoting of the control lever is effected to shift the brackets so that its bottom edge with the conveyor is shifted relative to the coal face for adjusting the height of movement of the conveyor.

Due to this design, the extension of the control bracket forms the conveyor support at the waste side. At the same time, the axis about which the conveyor with the planer is tilted is displaced beneath the conveyor. This results in a relatively favorable load distribution relative to the tilting axis. That is, it may be assumed that now the ratio of the weight of planer and planer guides with one portion of the conveyor, to the weight of the control mechanism and bracket and the other portion of the conveyor, will be approximately 2 to 1. The piston surface ratio of the lifting cylinder, namely the ratio of the full surface area remote from the piston rod to the annular area adjacent the piston rod, may then also be 2 to 1. Further, it is important that just upon bringing the planer into its climbing position in which the maximum load bears against the control mechanism, the extension of the control bracket beyond the side wall of the conveyor provides for a satisfactory support with a relatively small surface pressure, so that even with a soft footwall, the conveyor will hardly penetrate into the floor at the waste side.

While taking into account that a relatively small lifting cylinder can be employed in the inventive control mechanism, the invention further provides another feature which is important independently, but particularly in combination with the other features, namely that the control lever is braced by its lever end associated with the fixed hinge axis, against an abutment at the opposite side relative to the bracket, and has its lever end turned to the bracket connected to the piston rod of the lifting cylinder while forming a movable hinge axis, with the hinge axes of the lifting cylinder and the control lever forming a triangle of joints wherein the lifting cylinder which is substantially vertical in its normal position and the horizontal control lever are the sides and the line connecting the fixed hinge axes is the hypotenuse, and with the movable hinge axis extending at a location intermediate the hypotenuse and the control bracket.

In consequence, to lower the conveyor and bring the planer into a climbing position, the piston rod is now not retracted but extended, so that the entire surface area of the piston is available for the increased setting forces which, in the inventive design, are compressive. The other setting forces, namely the much smaller forces needed for lifting the conveyor at the waste side and bringing the planer into a dipping position, are not tensile forces which can easily be produced by exposing to the operating fluid, which is under constant pressure, the piston surface reduced by the cross section of the piston rod. For this reason again, a lifting cylinder with a relatively small piston and an overall reduced diameter may be provided for the inventive control mechanism. Irrespective thereof, due to the vertical arrangement of the lifting cylinder, even a reduced piston stroke will bring the planer into a climbing or dipping position, so that the cylinder may also be made shorter than before. The final result is that the lifting cylinder can now be dimensioned exactly for the required strokes and setting forces, and, due to its vertical extension, is in addition, mounted on the control bracket in protected position. This also enlarges the service space for the crew. With shield supports, the shield canopies can be extended to prevent a premature caving-in of the roof. An operative, reliable, and rugged construction is obtained having the above discussed advantages.

In one embodiment of the invention the abutment comprises a forked head of a shifting cylinder or a service trough and it forms with the control lever of the bracket a pivot head having a vertical pivoting axis. In another embodiment, the extension of the control bracket is constructed as a scraper skid which extends below the bottom of the conveyor, moves fine coal into the lower section of the longwall conveyor. The scraper skid defines a selected angle with the bottom of the conveyor. This scraper skid presents the fine coal from forming cakes, and the side wall of the conveyor from moving up on such cakes, so that disturbances resulting therefrom of the planer control are avoided. Actually, the scraper skid also performs the function of a sweeping sheet holding the entire space behind the control bracket, and the control mechanism there accommodated, free from coal dust and ensuring that the conveyor can again be lowered at the waste side for bringing the planer into a climbing position. In this connection, another inventive feature is to be taken into account namely that the scraper skid in normal position forms with the floor a clearance angle corresponding to the tilting angle above the tilting axis coinciding with the front edge of the extension of the control bracket. Soiling of the planer control mechanism is prevented to a large extent. In fact, during a shifting operation, the coal dust is swept by the scraper skid and pushed into the lower section of the conveyor and thus removed. Preferably, the scraper skid extends below the side wall of the conveyor at a predetermined distance in height, so that the control bracket can be used with various types and sizes of conveyors.

Accordingly, it is an object of the invention to provide a device for adjusting a coal planer conveyor in height as it moves over a coal face.

A further object of the invention is to provide a device for adjusting a coal planer conveyor which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
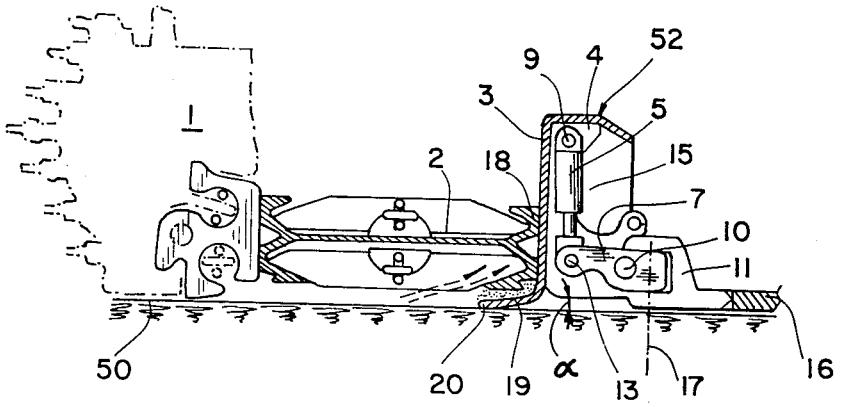
FIG. 1 is a transverse sectional view of an inventive planer control mechanism in normal position, showing also the longwall conveyor, and the planer guiding structure, and indicating the planer.
Figure 4:
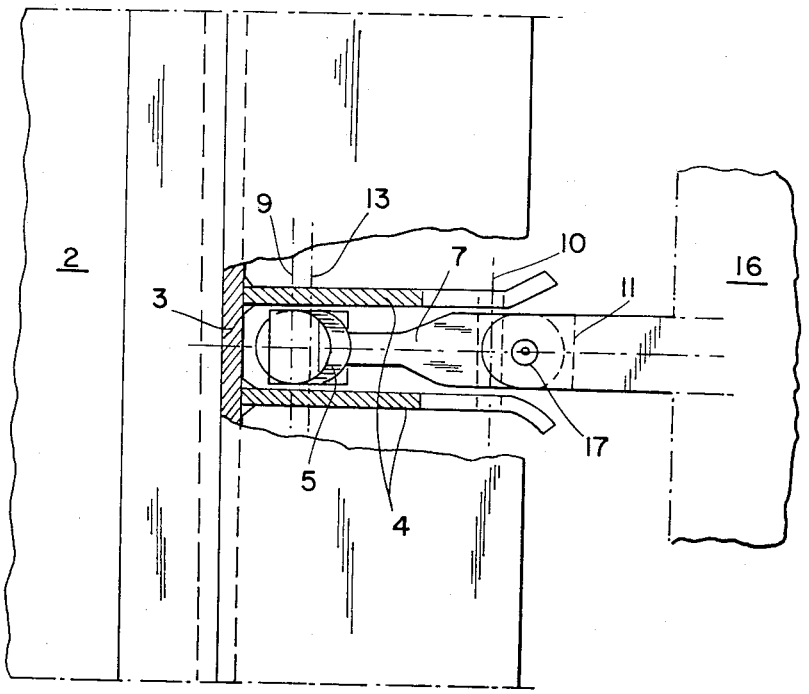
FIG. 4 is a top plan view of an enlarged detail of the waste side of FIG. 1.
Figure 2:
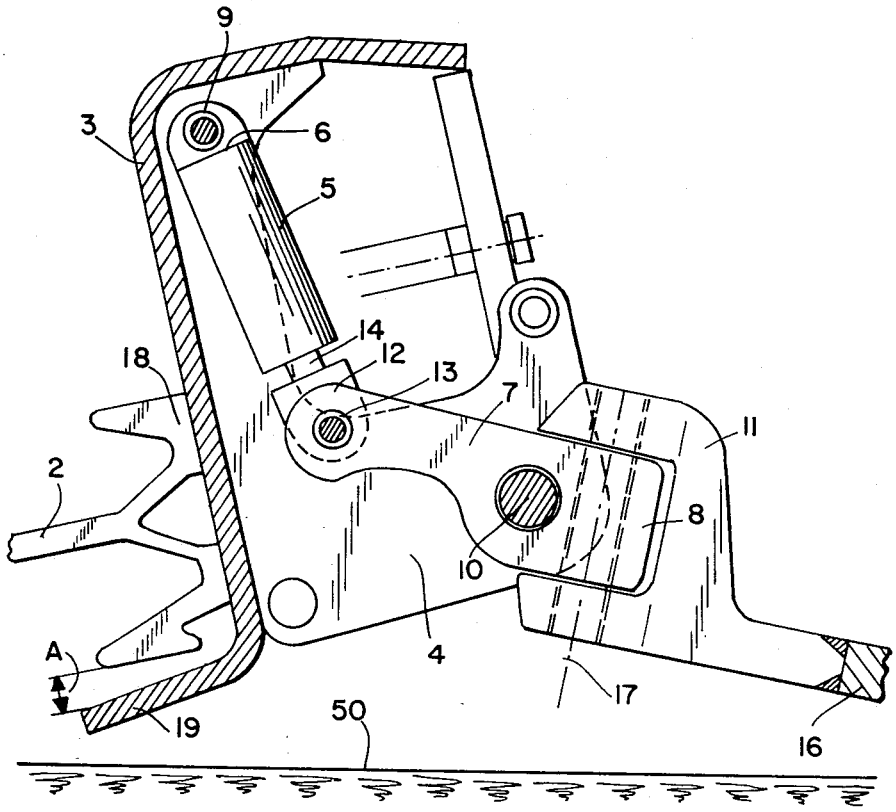
FIG. 2 is a detail from FIG. 1 showing the waste side in dipping position.
Figure 3:
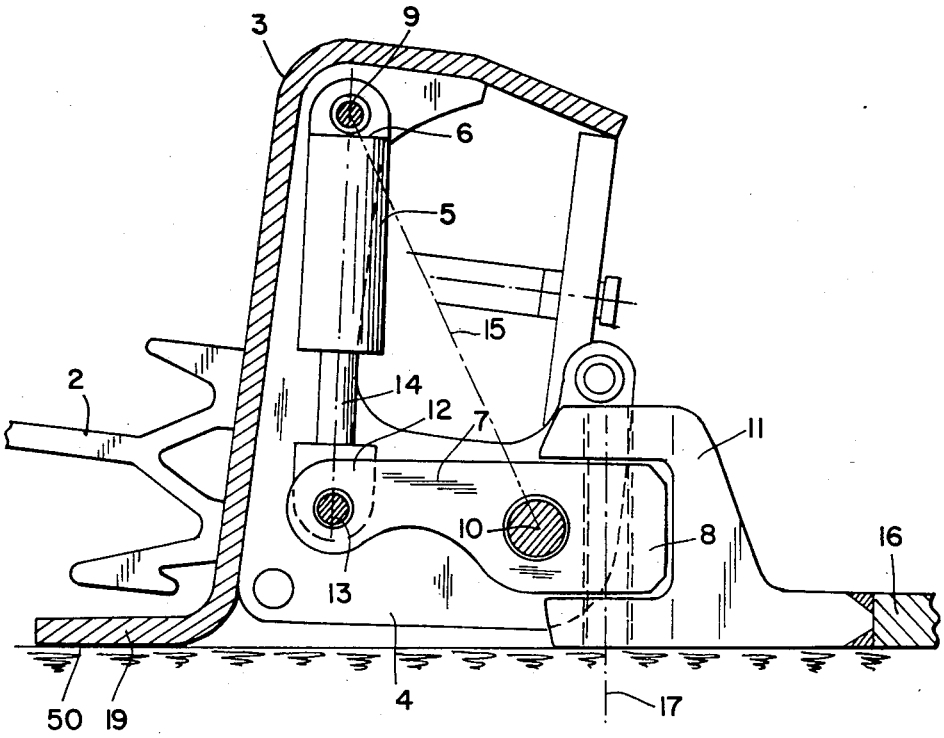
FIG. 3 is a view similar to FIG. 2, showing the climbing position.

Referring to the drawings in particular the invention embodied therein comprises a device for adjusting a coal planer conveyor generally designated 2 in height as it moves over a coal face 50 with a planer 1 on its one side and with a height adjusting device generally designated 52 on its opposite side. The height adjusting device 52 in accordance with the invention comprises a bracket 3 secured to the opposite side wall of the conveyor and it has a bottom edge 19 which extends at a selected spacing "A" (FIG. 2) below the bottom of the conveyor 2 and is angled in a direction toward the planer 1. As shown in FIG. 1, a clearance or tilting angle $\alpha$ which is defined by the angle which the bottom edge 19 makes with the coal face 50 may be varied with the adjusting mechanism in order to vary the directional height of the conveyor as it moves over the coal fact 50. The control device includes a control lever 7 which is pivotally mounted intermediate its ends on the bracket 3 and it has an outer arm portion 8 which is pivotally supported in an abutment 16 for pivotal movement about a vertical axis 17 and has an opposite inner end or arm portion 12 which is pivoted on a fixed pin 13 secured to a piston rod 14 of a fluid pressure operated combination piston and cylinder unit 5 which has its opposite ends pivotally mounted at 9 in the bracket 3 adjacent the upper end thereof. The fluid pressure operated piston and cylinder combination 5 is extensible and retractable in order to cause a shifting of the bottom edge 20 of the bottom edge 19 of the bracket 3 so that it engages the coal face 50 at a selected angle $\alpha$ and thus provides a guiding influence on the conveyor height.

The figures show a control mechanism for adjusting a coal planer in height, comprising a control bracket 3 which is secured to the waste-side wall of a longwall conveyor 2. Bracket 3 substantially comprises at least one supporting web 4 for hinging thereto at least one lifting cylinder 5 having its one end 6 pivotally mounted adjacent the upper end of the bracket, and at least one control lever 7 pivotally mounted in the lower zone of the bracket 3. The control lever 7 includes an inner arm portion 12 pivotally connected at pin 13 to the piston and cylinder combination 5 and an outer arm portion 8 pivotally connected to abutment 16 at 17. The hinge axes 9 and 10 of the lifting cylinder 5 and control lever 7 respectively are embodied as pins fixed to the supporting web 4. It is practical to provide in the central zone of control bracket 3 two supporting webs 4 spaced apart by a predetermined distance, and to mount lifting cylinder 5 and control lever 7 therebetween. However, lifting cylinder 5 and control lever 7 may also be designed with forked heads and pivoted to a central supporting web 4. Further provided may be an arresting device (not shown), equipped with a support adjustable in height, for fixing the angle set by the lifting cylinder and formed between the conveyor and the floor.

Control lever 7 is a two-armed lever pivotable about fixed hinge pin 10, and has an outer end 8 extending away from bracket 3 pivoted to an abutment 11 which is an element provided at the waste side and separate from bracket 3. The other end 12 of control lever 7, extending toward bracket 3, is hinged at 13 to a piston rod 14 of the lifting cylinder 5. A movable hinge axis 13 is thereby formed at the inside. The three hinge axes of pins 9,10,13 which determine the relative positions of the lifting cylinder and the control lever thus define a triangle of joints wherein the lifting cylinder 5 extending substantially vertically in normal position, and the substantially horizontally extending control lever 7 form the two sides, and the connecting line 15 between fixed hinge axes 9,10 forms the hypotenuse, with the movable hinge axis 13 extending between the hypotenuse and bracket 3. Piston rod 14 might also be hinged to the supporting web 4 and the cylinder end 6 to the control lever 7. An abutment for the control lever 7 is formed by a projecting arm backed up by the support structure of the conveyor workings. In the shown example, the abutment is embodied as the forked head 11 of a service trough 16. Forked head 11 forms together with the lever end 8 engaging therein of lever 7, a joint having a vertical pivotal axis 17 also that the control lever also performs the function of a crosshead lever.

Control bracket 3 comprises an extension which projects below the associated side wall 18 of the conveyor 2 with a clearance A, up to the return section of the conveyor, and the bracket bottom edge 19 is bent toward the coal face. This bottom edge 19 is designed as a scraper skid extending over the length of the bracket or a conveyor trough section, and ensures, during the shifting operation, that no coal dust cake forms below or behind the conveyor wall 18 at the waste side beneath the planer control mechanism, and that this mechanism is not affected in its function.

In addition, the front end of the bottom edge 19 forms a scraper skid 19 extending ahead of the conveyor side wall in the coal face direction, forms a tilting axis 20 at the end of the bottom 19 for conveyor 2 which supports a planer 1 as shown in FIG. 1. It is further provided that in a normal position, scraper skid 19 by which the coal dust is pushed to the return section of the conveyor, forms a clearance angle A with the floor or respective horizontal plane, which angle corresponds to the angle through which planer 1 is tilted about the axis 20, to bring it into the maximum climbing position. The clearance or tilting angle $\alpha$ therefore determines the limit climbing position of planer 1. The space at the waste side behind scraper skid 19 remains substantially free from coal dust, whereby disturbances due to soiling of the control mechanism are eliminated.

While a specific embodiment of the invention has been shown and described in detail to illustrate the application of the principles of the invention, it will be understood that the invention may be embodied otherwise without departing from such principles.

What is claimed is:

1. A device for adjusting a coal planer conveyor in height as it moves over a coal face with the planer carried on one side of the conveyor and wherein the conveyor includes an opposite side wall opposite to the planer side wall, comprising a bracket secured to the opposite side wall and having a bottom edge extending at a selected angle below the bottom of the conveyor in a direction toward the planer, a control lever having an outer arm and an opposite inner arm being pivotally mounted on a first axis intermediate its ends on said bracket, an abutment disposed on the opposite side of the conveyor, said control lever outer arm being pivotally supported on said abutment for pivoting about a substantially vertical axis, and a fluid pressure operated piston and cylinder combination pivotally connected between said upper portion of said bracket and said control lever inner arm portion and being extensible and retractable to cause the bottom edge to protrude by a selected amount into the coal face so as to vary the height of the coal planer, the connection of said fluid pressure operated piston and cylinder combination to said bracket comprising a fixed pin carried on said bracket defining a first pivot axis, the connection of said fluid pressure operated piston and cylinder combination to said control lever comprising a bracket tilt axis pin on said control lever defining a second pivot axis and the pivotal axis of said lever on said bracket defining a third pivot axis, all of said first, second and third pivot axes defining a triangle.

2. A device according to claim 1, wherein said bottom edge forms with the coal face a clearance angle of a predetermined amount.

3. A device according to claim 1, wherein said abutment comprises a forked head of a shifting cylinder, said forked head having arm portions embracing said lever on each side including a pin pivotally supporting said control lever between said arm portions for pivotal movement about a vertical axis.

4. A device according to claim 1, wherein said bottom edge of said bracket extends beyond the side wall of said conveyor and comprises a scraper skid moving coal into the lower section of the longwall conveyor.

5. A device according to claim 4, wherein said scraper skid extends at a predetermined distance below the bottom of said conveyor.

* * * * *